US006039545A

United States Patent [19]

Cauthen

[11] Patent Number: 6,039,545

[45] Date of Patent: Mar. 21, 2000

[54] METHOD AND APPARATUS FOR PRECISION METERING OF HIGH VISCOSITY MATERIALS

[75] Inventor: Mark Everette Cauthen, Charlotte, N.C.

[73] Assignee: Mahr Corporation, Charlotte, N.C.

[21] Appl. No.: 09/052,359

[22] Filed: Mar. 31, 1998

[51] Int. Cl.[7] ..... F04B 19/24

[52] U.S. Cl. ..... 417/53; 417/203; 417/205

[58] Field of Search ..... 417/53, 203, 205, 417/410.4

[56] References Cited

U.S. PATENT DOCUMENTS

| | | | |
|---|---|---|---|
| 3,746,481 | 7/1973 | Schippers | 418/83 |
| 3,881,654 | 5/1975 | Larkin | 239/127 |
| 4,072,248 | 2/1978 | Murphy et al. | 222/56 |
| 4,084,605 | 4/1978 | Franz | 137/101.11 |
| 4,931,249 | 6/1990 | Hune . | |
| 5,302,089 | 4/1994 | Maruyama et al. | 417/199.1 |
| 5,505,591 | 4/1996 | Tynan | 417/205 |
| 5,890,656 | 4/1999 | Fuhlbrigge | 239/227 |

FOREIGN PATENT DOCUMENTS 2085081 4/1982 United Kingdom .

OTHER PUBLICATIONS

Author: Mahr; Title of article: Feinpruef Spinning Pumps, Spin Finish Metering Pumps and Test Stands; Title of item: none; Date: May 5, 1997; pp. 3, 4, 10 and 11; Volume–issue number: none; Publisher: Mahr, Feinpruef Spinning Pump Division; Country where published: Germany.

Author: Mahr Feinpruef; Title of article: Spinning Pumps for the Production of Synthetic Fibres; Title of item: none; Date: Apr. 1, 1998; Pages: entire brochure; Volume–issue number: Publisher: Mahr, Feinpruef; Country where published: USA.

*Primary Examiner*—John A. Jeffery
*Assistant Examiner*—Vinod D Patel
*Attorney, Agent, or Firm*—Adams Law Firm, P.A.

[57] ABSTRACT

A pump for precision metered pumping of high viscosity materials. A pump housing has a material inlet and a material outlet, a drive gear and at least one cooperating driven gear for receiving material from the material inlet and pumping a metered amount of material to and out of the material outlet. A motor rotates the drive gear, and an impeller also driven by the motor feeds material under positive pressure into the material inlet where the material is metered and pumped downstream into the outlet.

10 Claims, 4 Drawing Sheets

METHOD AND APPARATUS FOR PRECISION METERING OF HIGH VISCOSITY MATERIALS

TECHNICAL FIELD AND BACKGROUND OF THE INVENTION

This invention relates to a method and apparatus for precision metering of high viscosity materials. The invention utilizes known gear pump technology with novel material feeding concepts to achieve extremely accurate delivery of very high viscosity materials at widely varying predetermined pressures. As used in this application, the term "high viscosity" means viscosity on the order of 3,000 centipoise or greater. Such materials are technically considered liquids, since they will assume the shape of the container within which they reside, but are so viscous that they will support significant weight. These factors are put to use in the practice of the present invention.

Gear pumps are well-known as devices which can meter and deliver extremely precise volumes of materials across a wide range of viscosities, temperatures and pressures. Properly maintained gear pumps have extremely long duty cycles, operate in harsh environments and are inherently resistant to process variations such as pulsation and surging. The robust nature of gear pumps make them ideal for metering precise quantities of materials at high pressures. Other pumps which are used for similar applications include piston, diaphragm, peristaltic and moyno pumps.

Gear pumps in the presence of low or no inlet pressure have heretofore not been usable with materials having extremely high viscosity, because the materials are too viscous to flow into the gear pump inlet. Auxiliary pumps used to create inlet pressure increase cost, complexity and introduce additional processing variables which often present unanticipated and unpredictable results. This invention relates to a modified gear pump which will feed itself extremely viscous materials while maintaining the precision and simplicity for which gear pumps are known. The metering gears and feeding means are driven in unison by the same motor, thus automatically matching feed and delivery rates.

SUMMARY OF THE INVENTION

Therefore, it is an object of the invention to provide a gear pump which precisely meters high viscosity materials in the absence of external inlet pressure.

It is another object of the invention to provide a gear pump which feeds itself high viscosity materials.

It is another object of the invention to provide a gear pump which delivers high viscosity materials to the gear pump inlet at a rate which matches or exceeds the metering rate of the pump.

It is another object of the invention to provide a gear pump which will operate while submerged in a high viscosity material.

It is another object of the invention to provide a gear pump which will operate while supported on the surface of a high viscosity material by the material itself.

It is another object of the invention to provide a gear pump which feeds the gear pump inlet with an impeller driven by the gear pump motor.

These and other objects of the present invention are achieved in the preferred embodiments disclosed below by providing in a gear pump having a material inlet, at least first and second cooperating material pumping gears and a material outlet, the improvement material feeding means positioned upstream from the material inlet for feeding high viscosity material under positive pressure into the material inlet.

According to one preferred embodiment of the invention, the gear pump includes a motor for driving the material feeding means.

According to another preferred embodiment of the invention, the motor drives the first gear.

According to yet another preferred embodiment of the invention, the material feeding means comprises an impeller, and the impeller and the first gear are both driven by the motor.

According to yet another preferred embodiment of the invention, the motor includes a drive shaft, and the first gear and the impeller are coaxially-mounted on the drive shaft for rotation therewith.

According to yet another preferred embodiment of the invention, a pump for precision metered pumping of high viscosity materials is provided, comprising a pump housing having a material inlet and a material outlet, a drive gear and at least one cooperating driven gear for receiving material from the material inlet and pumping a metered amount of material to and out of the material outlet, drive means for rotating the drive gear, and material feeding means driven by the drive means for feeding material under positive pressure into the material inlet.

According to yet another preferred embodiment of the invention, the drive means comprises a motor having a drive shaft, the material feeding means comprises an impeller, and the drive gear and the impeller are coaxially-mounted on the drive shaft for rotation therewith.

According to yet another preferred embodiment of the invention, the gear pump includes a base plate, and the material inlet and the material outlet are positioned in the base plate and communicate with the drive gear and the driven gear through the base plate.

According to yet another preferred embodiment of the invention, the base plate includes a recess formed therein eccentric to the material inlet. The impeller is positioned in the recess in eccentrically overlying relation to the inlet.

An embodiment of the method according to the invention comprises a method of metering precise quantities of high viscosity materials, and includes the steps of providing a gear pump having an inlet, at least two cooperating metering and pumping gears in material-receiving relation to the inlet and a material outlet for delivering metered material from the pumping gears. Material is forced under positive pressure into the inlet and into pumping position relative to the metering and pumping gears.

According to yet another preferred embodiment of the invention, the step of forcing material under positive pressure into the inlet comprises the step of rotating an impeller in contact with the material.

According to yet another preferred embodiment of the invention, the method includes the steps of allowing the gear pump to be supported on the material and utilizing the impeller to progressively move the gear pump into the material as the material is forced into the inlet.

According to yet another preferred embodiment of the invention, the drive gear and the impeller deliver material at the same rate.

According to yet another preferred embodiment of the invention, the gear pump is submerged in the material.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
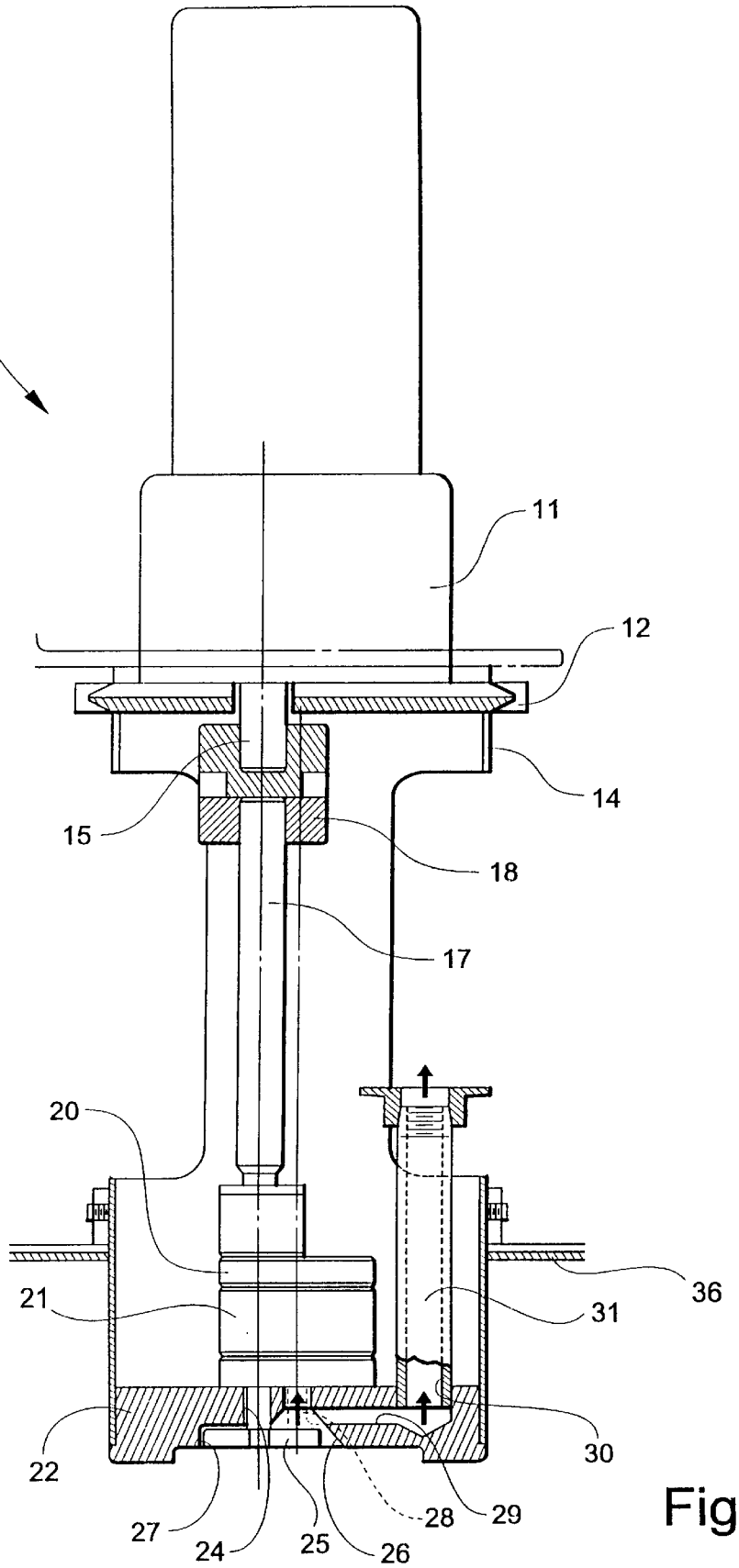
FIG. 1 is a vertical cross-section of a gear pump according to an embodiment of the invention.
Figure 2:
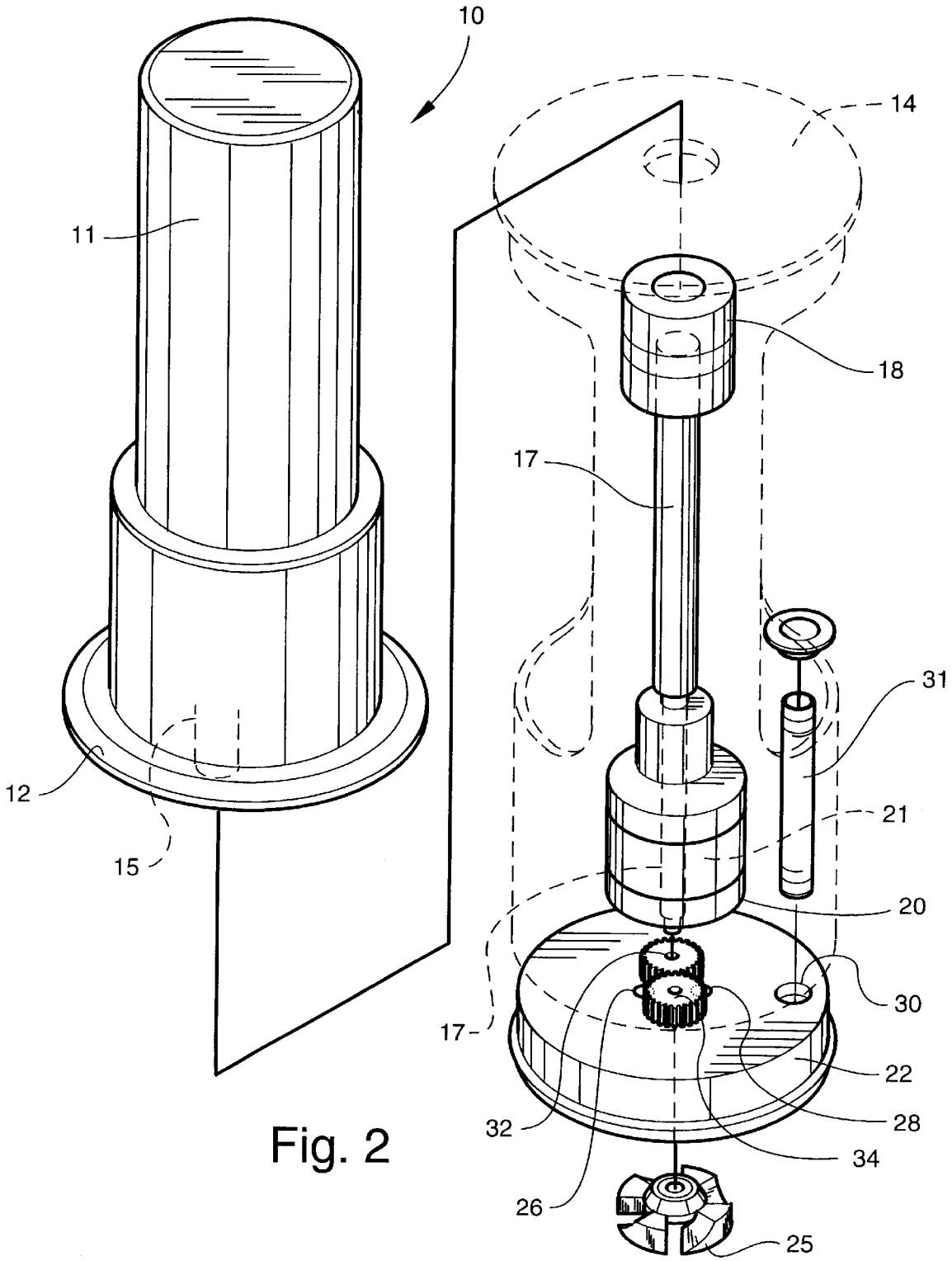
FIG. 2 is an exploded, perspective view of a gear pump as shown in FIG. 1.
Figure 3:
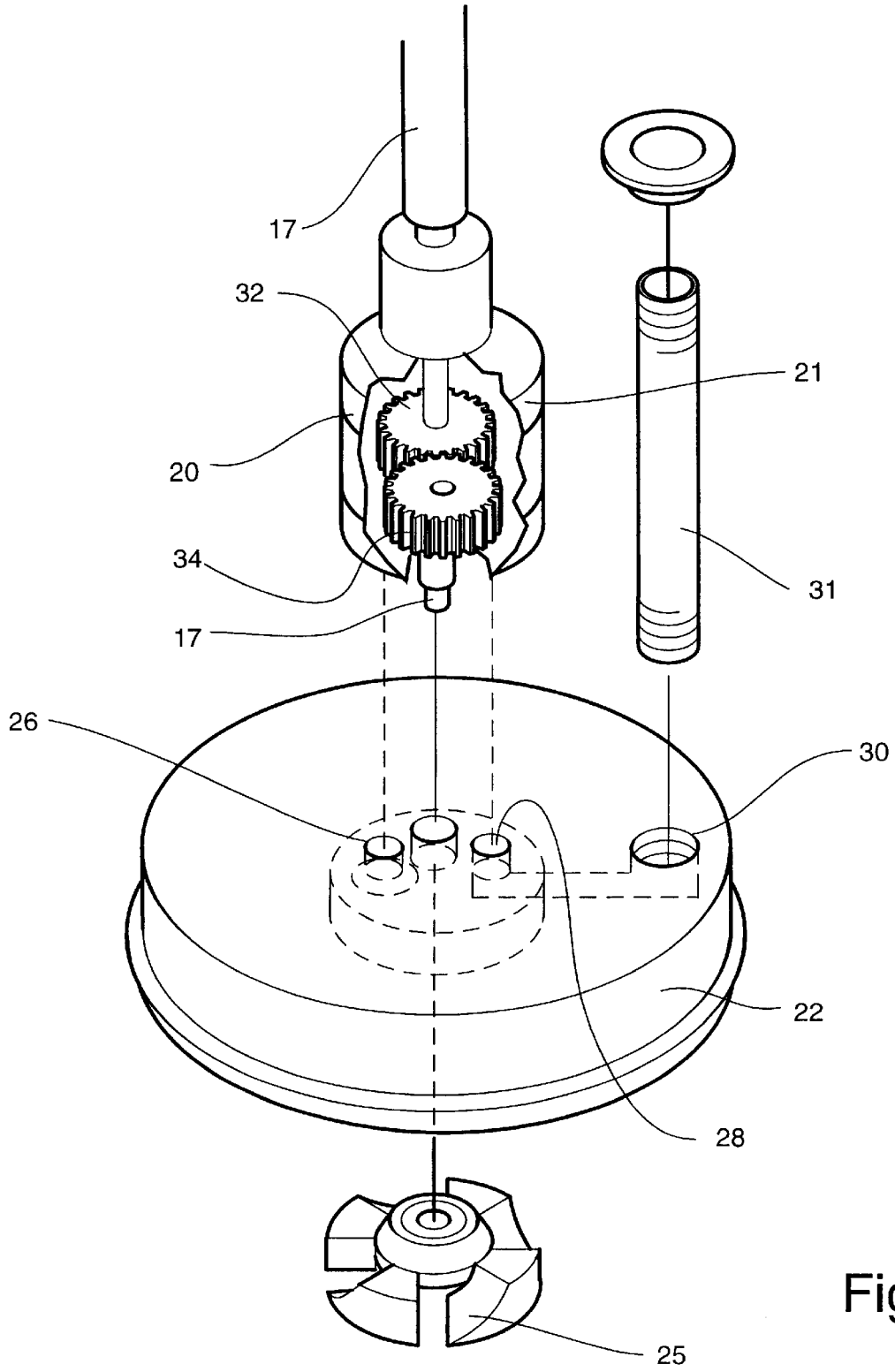
FIG. 3 is a is an enlarged, exploded perspective view of the metering portion of the gear pump.
Figure 4:
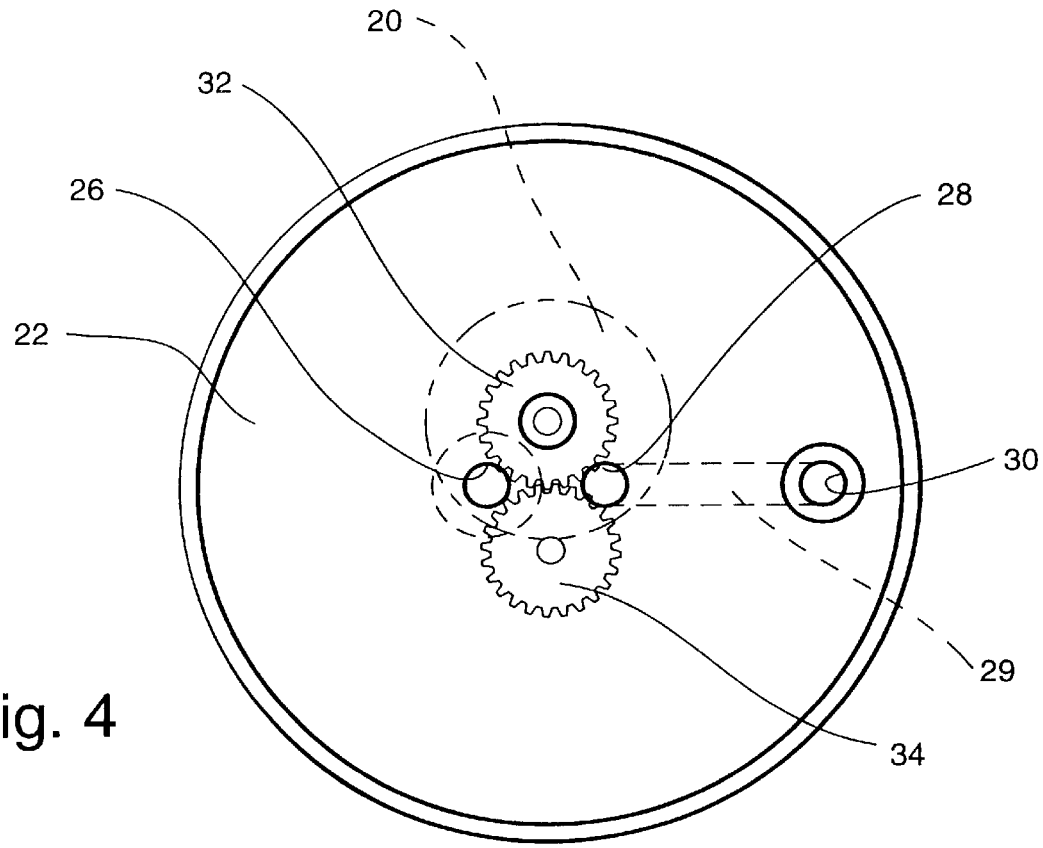
FIG. 4 is a fragmentary top plan view of the base plate portion of the gear pump.
Figure 5:
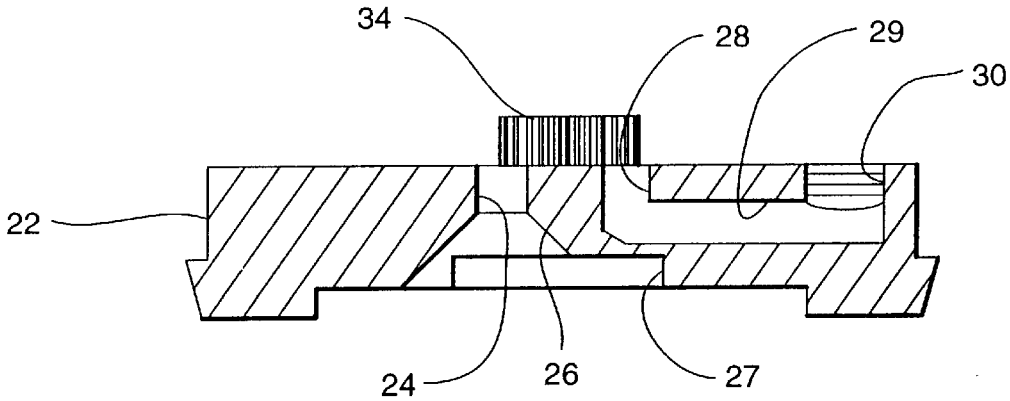
FIG. 5 is a vertical cross-section of the base plate portion of the gear pump.

Referring now specifically to the drawings, a gear pump assembly according to the present invention is illustrated in FIG. 1 and shown generally at reference numeral 10. The particular embodiment of the gear pump disclosed in this application is intended for feeding high viscosity material from a drum or other large container. A gear motor 11, for example, a Bodine 40:1 ratio motor with an output speed of 62 rpm is mounted by means of a mounting flange 12 to a pump frame 14. The drive shaft 15 of gear motor 11 is mated to a pump drive shaft extension 17 through a break-away safety coupling 18.

A metering pump 20, such as Feinpruef 4.5 cc/rev. metering pump, includes a housing 21 mounted on a base plate 22 of the pump frame 14. The pump drive shaft extension 17 couples to the drive shaft of the metering pump 20 and extends completely through the housing of the metering pump 20 and through a bore 24 in the base plate 22. An impeller 25 is mounted on the lower end of the pump drive shaft extension 17 and resides for rotation with the drive shaft extension 17 in a recess 28 formed in the bottom of base plate 22.

As is also shown in FIG. 1, the base plate 22 includes a pump inlet 26 and a pump outlet 28 which communicate with the metering pump 20. The inlet 26 and the recess 27 communicate in the manner shown particularly in FIG. 1. Note that the inlet 26 and the recess 27 are eccentric with respect to each other, and that the inlet 26 is eccentric with respect to the impeller 25. The rotation of the impeller 25 converts rotational movement of the material into axial movement as the impeller blades carve into the material. The offset location of the inlet 26 relative to the impeller 25 positions the material to be forced into the inlet 26.

Pump outlet 28 includes a radially-extending passage 29 through the base plate 22 to an opening 30 in the base plate 22. An outlet extension 31 permits attachment to any desired downstream device for receiving the metered and pumped material. The entire unit may be supported in or on a container by an adjustable flange 36. Referring now to FIGS. 2–5, the gear pump assembly 10 is shown in greater detail. Note particularly that the metering pump 20 operates on the principle that material can be precisely metered and delivered under high pressure by the interaction of two or more mated gears. In FIGS. 2–5 metering gears 32 and 34 are shown in position on the top surface of the base plate 22, in order to orient them in relation to the material inlet 26 and material outlet 28. In operation, the gears 32 and 34 reside within the housing 21 of metering pump 20. As is shown particularly in FIGS. 2 and 3, gear 32 is a drive gear, and is mounted for rotation on the pump drive shaft 17. Gear 32 meshes with gear 34 and drives gear 34, a driven gear, in with gear 32. Material introduced into the metering pump 20 is thus moved downstream into the material outlet 28 in accordance with known principles.

The unique feature of the gear pump 10 is the ability of the pump to meter and deliver precise quantities of high viscosity material—material so viscous that it will not flow into the inlet 26 under atmospheric pressure or static pressure created by the weight of the material in a container. Therefore, the inlet 26 is fed under positive pressure induced by rotation of the impeller 25. Impeller 25 rotates with the drive gear 32, whose drive shaft 17 it shares. The base plate 22 need be only in contact with the material to be fed, and the rotation of the impeller 25 carves away material and mechanically diverts it under positive, dynamic pressure into the inlet 26. The size, shape and angle of the impeller blades of the impeller 25 are designed to match the relative flow rate of the gears 32 and 34. Thus, the impeller 25 will feed material at a rate appropriate to the metering rate of the gears 32 and 34 at any rpm within the operating range of the metering pump 20. This is distinct and highly desirable advantage over use of a separately-driven feeding apparatus, which must be flow rate-adjusted to the metering rate of the gear pump, and whose flow rate may fluctuate due to numerous operating variables without regard to the metering rate of the gears 32 and 34.

The design of the gear pump assembly 10 is such that the unit can be mounted in or on a container such as a barrel and supported on the material itself. Operation of the gear pump 10 will cause the gear pump 10 to "eat" its way to the bottom of the container as the impeller 25 forces material into the inlet 26.

A gear pump assembly with an impeller feed is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a gear pump having a material inlet, at least first and second cooperating material pumping gears and a material outlet, the improvement comprising material feeding means positioned upstream from the material inlet for feeding high viscosity material under positive pressure into said material inlet, said gear pump including a motor for driving said material feeding means, and said material feeding means comprises an impeller, and said impeller and said first gear are both driven by said motor.

2. In a gear pump according to claim 1, wherein said motor drives said first gear.

3. In a gear pump according to claim 1, wherein said motor includes a drive shaft and said first gear and said impeller are coaxially-mounted on said drive shaft for rotation therewith.

4. A gear pump for precision metered pumping of high viscosity materials, comprising:

(a) a pump housing having a material inlet and a material outlet;

(b) a drive gear and at least one cooperating driven gear for receiving material from said material inlet and pumping a metered amount of material to and out of said material outlet;

(c) drive means comprising a motor having a drive shaft for rotating said drive gear; and (d) material feeding means driven by said drive means for feeding material under positive pressure into said material inlet, said material feeding means comprises an impeller, and wherein said drive gear and said impeller are coaxially-mounted on said drive shaft for rotation therewith.

5. A gear pump according to claim 4, including a base plate, and wherein said material inlet and said material outlet are positioned in said base plate and communicate with said drive gear and said driven gear through said base plate.

6. A gear pump according to claim 5, wherein said base plate includes a recess formed therein eccentric to said material inlet, and wherein said impeller is positioned in said recess in eccentrically overlying relation to said inlet.

7. A method of metering precise quantities of high viscosity materials, comprising the steps of:

(a) providing a gear pump having an inlet, at least two cooperating metering and pumping gears in material-receiving relation to said inlet and a material outlet for delivering metered material from said pumping gears; and (b) forcing material under positive pressure into said inlet and into pumping position relative to said metering and pumping gears, wherein the step of forcing material under positive pressure into said inlet comprises the step of rotating an impeller in contact with said material.

8. A method according to claim 7, and including the steps of: (a) allowing said gear pump to be supported on said material;

(b) utilizing said impeller to progressively move the gear pump into the material as the material is forced into said inlet.

9. A method according to claim 8, wherein said drive gear and said impeller deliver material at the same rate.

10. A method according to claim 7 wherein said gear pump is submerged in said material.

* * * * *